US011295687B2

(12) United States Patent
Zhu

(10) Patent No.: US 11,295,687 B2
(45) Date of Patent: Apr. 5, 2022

(54) GOA DEVICE AND GATE DRIVING CIRCUIT

(71) Applicant: TCL CHINA STAR OPTOELECTRONICS TECHNOLOGY CO., LTD., Shenzhen (CN)

(72) Inventor: Jing Zhu, Shenzhen (CN)

( * ) Notice: Subject to any disclaimer, the term of this patent is extended or adjusted under 35 U.S.C. 154(b) by 108 days.

(21) Appl. No.: 16/626,334

(22) PCT Filed: Dec. 10, 2019

(86) PCT No.: PCT/CN2019/124354

§ 371 (c)(1),
(2) Date: Dec. 24, 2019

(87) PCT Pub. No.: WO2021/072948

PCT Pub. Date: Apr. 22, 2021

(65) Prior Publication Data

US 2021/0335310 A1 Oct. 28, 2021

(30) Foreign Application Priority Data

Oct. 16, 2019 (CN) ..... 201910983741.9

(51) Int. Cl.
*G09G 3/36* (2006.01)

(52) U.S. Cl.
CPC ..... *G09G 3/3677* (2013.01); *G09G 3/36* (2013.01); *G09G 2310/0267* (2013.01)

(58) Field of Classification Search
CPC .. G09G 3/3677; G09G 3/3676; G09G 3/3696; G09G 3/20; G09G 3/2092; G09G 2300/0408; G09G 2300/0426; G09G 2310/0286; G09G 2310/08; G09G 2310/06; G09G 2310/0224; G09G 2310/0267; G09G 2310/0291; G09G 2320/0219; G11C 19/28; G11C 19/287
See application file for complete search history.

(56) References Cited

U.S. PATENT DOCUMENTS

| | | | | |
|---|---|---|---|---|
| 9,390,674 | B2 * | 7/2016 | Xiao | G11C 19/28 |
| 9,613,582 | B2 * | 4/2017 | Kim | G11C 19/28 |
| 9,633,620 | B2 * | 4/2017 | Cao | G11C 19/28 |
| 9,786,228 | B2 * | 10/2017 | Ma | G11C 19/287 |
| 10,725,579 | B2 * | 7/2020 | Li | G09G 3/3677 |
| 10,748,465 | B2 * | 8/2020 | Zou | G09G 3/3677 |
| 11,043,179 | B1 * | 6/2021 | Xu | G09G 3/3677 |

(Continued)

FOREIGN PATENT DOCUMENTS

| | | | |
|---|---|---|---|
| CN | 108735177 | A | 11/2013 |
| CN | 104505048 | A | 4/2015 |

(Continued)

*Primary Examiner* — Vijay Shankar

(57) ABSTRACT

A GOA device and a gate driving circuit are provided. A pull-up control unit and a bootstrap unit sequentially control a control node of an Nth stage GOA unit to be pulled up to a first high voltage level and a second high voltage level. A pull-up unit outputs a gate driving signal according to a change of a voltage level of the control node and a stage transfer signal of the Nth stage GOA unit. As such, a pulse width of the gate driving signal is increased, and the problem that the charging ability is not sufficient can be solved.

14 Claims, 1 Drawing Sheet

(56) References Cited

U.S. PATENT DOCUMENTS

| | | | | |
|---|---|---|---|---|
| 11,087,713 | B1 * | 8/2021 | He | G09G 3/3696 |
| 2015/0213746 | A1 | 7/2015 | Kim | |
| 2016/0125830 | A1 | 5/2016 | Xiao | |
| 2016/0307535 | A1 | 10/2016 | Xiao | |
| 2016/0343335 | A1 | 11/2016 | Cao | |
| 2017/0243555 | A1 | 8/2017 | Cao | |
| 2017/0243556 | A1 | 8/2017 | Cao | |
| 2021/0174758 | A1 * | 6/2021 | Liu | G06F 1/06 |

FOREIGN PATENT DOCUMENTS

| | | | |
|---|---|---|---|
| CN | 104537987 | A | 4/2015 |
| CN | 104795034 | A | 7/2015 |
| CN | 110070838 | A | 7/2019 |

* cited by examiner

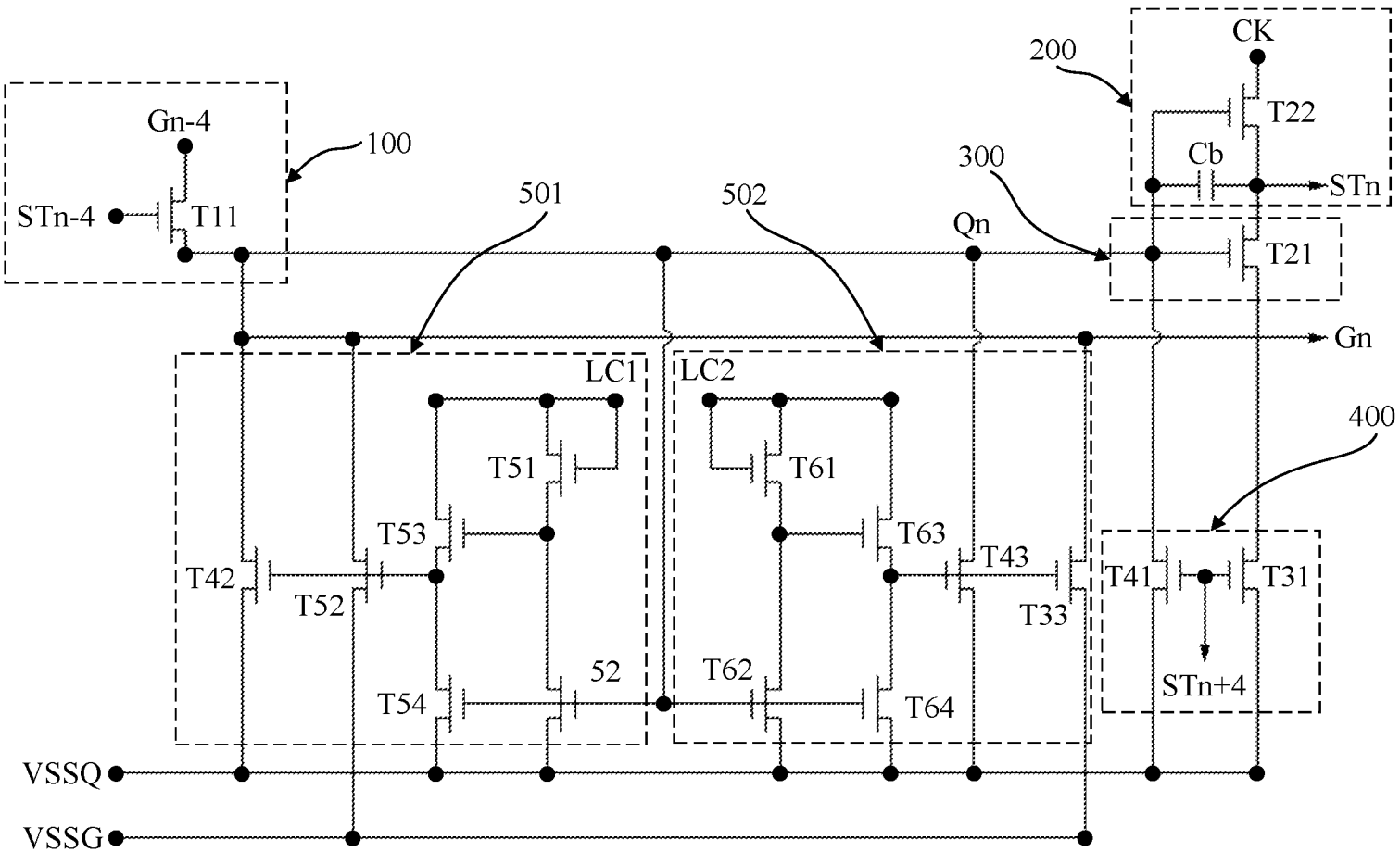
CK
T22
Cb
STn
T21
Gn
400
T31
STn+4
T41
200
300
Qn
T43
T33
T63
T64
T61
T62
502
LC2
LC1
52
T51
501
T53
T54
T52
100
T42
Gn-4
T11
STn-4
VSSQ
VSSG

GOA DEVICE AND GATE DRIVING CIRCUIT

BACKGROUND

This application claims the priority of Chinese Patent Application No. 201910983741.9, entitled "GOA DEVICE AND GATE DRIVING CIRCUIT", filed on Oct. 16, 2019 in the CNIPA (National Intellectual Property Administration, PRC), the disclosure of which is incorporated herein by reference in its entirety.

FIELD

The present disclosure relates to the display panel manufacturing field, and more particularly to a GOA device and a gate driving circuit.

BACKGROUND

In the gate drive on array (GOA) technology, scan line driving circuits are integrated on an array substrate of a liquid crystal display, so that a product cost can be decreased due to a material cost and a manufacturing process.

For a display panel having a high resolution and a high frequency (e.g., 120 Hz), a charge time is short, and capacitive loads of scan lines are heavy. Accordingly, distortions of gate pulse signals are serious. A value of a falling time of an output signal of a gate signal line is large, so that a risk of wrong charging is high. In the prior art, a time interval from a transition time point of a scan line to a transition time point of a data line is lengthened, and thus the charging time is shortened. A technical problem that a charging ability is not sufficient occurs.

Consequently, there is a need to provide a gate driving circuit to solve the above-mentioned technical problem in the prior art.

SUMMARY OF DISCLOSURE

The present disclosure provides a GOA device and a gate driving circuit to solve the technical problem that a charging ability is not sufficient.

The present disclosure provides a GOA device including at least two GOA units which are cascaded. An Nth stage GOA unit of the GOA units is configured to output a gate driving signal to an Nth horizontal scan line. The Nth stage GOA unit includes a pull-up control unit, a bootstrap unit, a pull-up unit, a pull-down unit, and a pull-down holding unit.

The pull-up control unit receives a starting signal to pull up a control node (Qn) of the Nth stage GOA unit to a first high voltage level in a first phase.

The bootstrap unit pulls up, according to a clock signal, the control node (Qn) of the Nth stage GOA unit to a second high voltage level in a second phase.

The pull-up unit outputs, according to the first high voltage level and the second high voltage level of the control node (Qn) of the Nth stage GOA unit and the clock signal outputted by the bootstrap unit, the gate driving signal to a gate signal terminal (Gn) of the Nth stage GOA unit, and a pulse width of the gate driving signal is twice a pulse width of the clock signal.

The pull-down unit pulls down the control node (Qn) of the Nth stage GOA unit and the gate signal terminal (Gn) of the Nth stage GOA unit to a first direct current low voltage level in a third phase.

The pull-down holding unit maintains the control node (Qn) of the Nth stage GOA unit as the first direct current low voltage level and maintains the gate signal terminal (Gn) of the Nth stage GOA unit as a second direct current low voltage level in a fourth phase.

In the GOA device of the present disclosure, the pull-up control unit is electrically coupled to a stage transfer signal terminal (STn−4) and a gate signal terminal (Gn−4) of an (N−4)th stage GOA unit and the control node (Qn) of the Nth stage GOA unit.

In the first phase, the pull-up control unit receives the starting signal from the stage transfer signal terminal (STn−4) of the (N−4)th stage GOA unit to pull up the control node (Qn) of the Nth stage GOA unit to the first high voltage level.

In the GOA device of the present disclosure, the pull-up control unit comprises an eleventh thin film transistor (T11).

A gate of the eleventh thin film transistor (T11) is electrically coupled to the stage transfer signal terminal (STn−4) of the (N−4)th stage GOA unit, a source of the eleventh thin film transistor (T11) is electrically coupled to a gate signal terminal (Gn−4) of the (N−4)th stage GOA unit, and a drain of the eleventh thin film transistor (T11) is electrically coupled to the control node (Qn) of the Nth stage GOA unit.

In the GOA device of the present disclosure, the bootstrap unit is electrically coupled to the control node (Qn) of the Nth stage GOA unit, a clock signal terminal (CK), and a stage transfer signal terminal (STn) of the Nth stage GOA unit.

The clock signal terminal (CK) is configured to provide the clock signal.

The second phase starts when the control node (Qn) of the Nth stage GOA unit is pulled up to the first high voltage level.

In the GOA device of the present disclosure, the bootstrap unit comprises a bootstrap capacitor and a twenty-second thin film transistor (T22).

The bootstrap capacitor is electrically coupled to the control node (Qn) of the Nth stage GOA unit and the stage transfer signal terminal (STn) of the Nth stage GOA unit.

A gate of the twenty-second thin film transistor (T22) is electrically coupled to the control node (Qn) of the Nth stage GOA unit, a source of the twenty-second thin film transistor (T22) is electrically coupled to the clock signal terminal (CK), and a drain of the twenty-second thin film transistor (T22) is electrically coupled to the stage transfer signal terminal (STn) of the Nth stage GOA unit.

In the GOA device of the present disclosure, the pull-up unit is electrically coupled to the control node (Qn) of the Nth stage GOA unit, the stage transfer signal terminal (STn) of the Nth stage GOA unit, and the gate signal terminal (Gn) of the Nth stage GOA unit.

The stage transfer signal terminal (STn) of the Nth stage GOA unit is configured to provide a starting signal to control a thin film transistor in the pull-up unit to be turned on and off.

In the GOA device of the present disclosure, the pull-up unit comprises a twenty-first thin film transistor (T21).

A gate of the twenty-first thin film transistor (T21) is electrically coupled to the control node (Qn) of the Nth stage GOA unit, a source of the twenty-first thin film transistor (T21) is electrically coupled to the stage transfer signal terminal (STn) of the Nth stage GOA unit, and a drain of the twenty-first thin film transistor (T21) is electrically coupled to the gate signal terminal (Gn) of the Nth stage GOA unit.

In the GOA device of the present disclosure, the pull-down unit is electrically coupled to the control node (Qn) of the Nth stage GOA unit, the gate signal terminal (Gn) of the Nth stage GOA unit, a transfer signal terminal (STn+4) of an (N+4)th stage GOA unit, and a first direct current low voltage level terminal (VSSQ).

The first direct current low voltage level terminal (VSSQ) is configured to provide the first direct current low voltage level.

The third phase starts when the transfer signal terminal (STn+4) of the (N+4)th stage GOA unit is at a high voltage level.

In the GOA device of the present disclosure, the pull-down unit comprises a thirty-first thin film transistor (T31) and a forty-first thin film transistor (T41).

A source of the thirty-first thin film transistor (T31) is electrically coupled to the gate signal terminal (Gn) of the Nth stage GOA unit, and a source of the forty-first thin film transistor (T41) is electrically coupled to the control node (Qn) of the Nth stage GOA unit.

A drain of the thirty-first thin film transistor (T31) and a drain of the forty-first thin film transistor (T41) are electrically coupled to the first direct current low voltage level terminal (VSSQ), and a gate of the thirty-first thin film transistor (T31) and a gate of the forty-first thin film transistor (T41) are electrically coupled to the transfer signal terminal (STn+4) of the (N+4)th stage GOA unit.

The present disclosure further provides a gate driving circuit. The gate driving circuit includes a GOA device including at least two GOA units which are cascaded. An Nth stage GOA unit of the GOA units is configured to output a gate driving signal to an Nth horizontal scan line. The Nth stage GOA unit includes a pull-up control unit, a bootstrap unit, a pull-up unit, a pull-down unit, and a pull-down holding unit.

The pull-up control unit receives a starting signal to pull up a control node (Qn) of the Nth stage GOA unit to a first high voltage level in a first phase.

The bootstrap unit pulls up, according to a clock signal, the control node (Qn) of the Nth stage GOA unit to a second high voltage level in a second phase.

The pull-up unit outputs, according to the first high voltage level and the second high voltage level of the control node (Qn) of the Nth stage GOA unit and the clock signal outputted by the bootstrap unit, the gate driving signal to a gate signal terminal (Gn) of the Nth stage GOA unit, and a pulse width of the gate driving signal is twice a pulse width of the clock signal.

The pull-down unit pulls down the control node (Qn) of the Nth stage GOA unit and the gate signal terminal (Gn) of the Nth stage GOA unit to a first direct current low voltage level in a third phase.

The pull-down holding unit maintains the control node (Qn) of the Nth stage GOA unit as the first direct current low voltage level and maintains the gate signal terminal (Gn) of the Nth stage GOA unit as a second direct current low voltage level in a fourth phase.

In the gate driving circuit of the present disclosure, the pull-up control unit is electrically coupled to a stage transfer signal terminal (STn−4) and a gate signal terminal (Gn−4) of an (N−4)th stage GOA unit and the control node (Qn) of the Nth stage GOA unit.

In the first phase, the pull-up control unit receives the starting signal from the stage transfer signal terminal (STn−4) of the (N−4)th stage GOA unit to pull up the control node (Qn) of the Nth stage GOA unit to the first high voltage level.

In the gate driving circuit of the present disclosure, the pull-up control unit comprises an eleventh thin film transistor (T11).

A gate of the eleventh thin film transistor (T11) is electrically coupled to the stage transfer signal terminal (STn−4) of the (N−4)th stage GOA unit, a source of the eleventh thin film transistor (T11) is electrically coupled to a gate signal terminal (Gn−4) of the (N−4)th stage GOA unit, and a drain of the eleventh thin film transistor (T11) is electrically coupled to the control node (Qn) of the Nth stage GOA unit.

In the gate driving circuit of the present disclosure, the bootstrap unit is electrically coupled to the control node (Qn) of the Nth stage GOA unit, a clock signal terminal (CK), and a stage transfer signal terminal (STn) of the Nth stage GOA unit.

The clock signal terminal (CK) is configured to provide the clock signal.

The second phase starts when the control node (Qn) of the Nth stage GOA unit is pulled up to the first high voltage level.

In the gate driving circuit of the present disclosure, the bootstrap unit comprises a bootstrap capacitor and a twenty-second thin film transistor (T22).

The bootstrap capacitor is electrically coupled to the control node (Qn) of the Nth stage GOA unit and the stage transfer signal terminal (STn) of the Nth stage GOA unit.

A gate of the twenty-second thin film transistor (T22) is electrically coupled to the control node (Qn) of the Nth stage GOA unit, a source of the twenty-second thin film transistor (T22) is electrically coupled to the clock signal terminal (CK), and a drain of the twenty-second thin film transistor (T22) is electrically coupled to the stage transfer signal terminal (STn) of the Nth stage GOA unit.

In the gate driving circuit of the present disclosure, the pull-up unit is electrically coupled to the control node (Qn) of the Nth stage GOA unit, the stage transfer signal terminal (STn) of the Nth stage GOA unit, and the gate signal terminal (Gn) of the Nth stage GOA unit.

The stage transfer signal terminal (STn) of the Nth stage GOA unit is configured to provide a starting signal to control a thin film transistor in the pull-up unit to be turned on and off.

In the gate driving circuit of the present disclosure, the pull-up unit comprises a twenty-first thin film transistor (T21).

A gate of the twenty-first thin film transistor (T21) is electrically coupled to the control node (Qn) of the Nth stage GOA unit, a source of the twenty-first thin film transistor (T21) is electrically coupled to the stage transfer signal terminal (STn) of the Nth stage GOA unit, and a drain of the twenty-first thin film transistor (T21) is electrically coupled to the gate signal terminal (Gn) of the Nth stage GOA unit.

In the gate driving circuit of the present disclosure, the pull-down unit is electrically coupled to the control node (Qn) of the Nth stage GOA unit, the gate signal terminal (Gn) of the Nth stage GOA unit, a transfer signal terminal (STn+4) of an (N+4)th stage GOA unit, and a first direct current low voltage level terminal (VSSQ).

The first direct current low voltage level terminal (VSSQ) is configured to provide the first direct current low voltage level.

The third phase starts when the transfer signal terminal (STn+4) of the (N+4)th stage GOA unit is at a high voltage level.

In the gate driving circuit of the present disclosure, the pull-down unit comprises a thirty-first thin film transistor (T31) and a forty-first thin film transistor (T41).

A source of the thirty-first thin film transistor (T31) is electrically coupled to the gate signal terminal (Gn) of the Nth stage GOA unit, and a source of the forty-first thin film transistor (T41) is electrically coupled to the control node (Qn) of the Nth stage GOA unit.

A drain of the thirty-first thin film transistor (T31) and a drain of the forty-first thin film transistor (T41) are electrically coupled to the first direct current low voltage level terminal (VSSQ), and a gate of the thirty-first thin film transistor (T31) and a gate of the forty-first thin film transistor (T41) are electrically coupled to the transfer signal terminal (STn+4) of the (N+4)th stage GOA unit.

In the present disclosure, the pull-up control unit and the bootstrap unit sequentially control the control node of the Nth stage GOA unit to be pulled up to the first high voltage level and the second high voltage level. The pull-up unit outputs the gate driving signal according to the change of the voltage level of the control node and the stage transfer signal of the Nth stage GOA unit. As such, the pulse width of the gate driving signal is increased, and the problem that the charging ability is not sufficient can be solved.

BRIEF DESCRIPTION OF DRAWINGS

FIG. 1 illustrates a circuit structure diagram of a GOA device of the present disclosure.

DETAILED DESCRIPTION OF EMBODIMENTS

To make the objectives, technical schemes, and technical effects of the present disclosure more clearly and definitely, the present disclosure will be described in details below by using embodiments in conjunction with the appending drawings. It should be understood that the specific embodiments described herein are merely for explaining the present disclosure but are not intended to limit the present disclosure.

For a display panel having a high resolution and a high frequency (e.g., 120 Hz), a charge time is short, and capacitive loads of scan lines are heavy. Accordingly, distortions of gate pulse signals are serious. A value of a falling time of an output signal of a gate signal line is large, so that a risk of wrong charging is high. In the prior art, a time interval from a transition time point of a scan line to a transition time point of a data line is lengthened, and thus the charging time is shortened. A technical problem that a charging ability is not sufficient occurs. The present disclosure provides a GOA device based on the above-mentioned technical problem.

Please refer to FIG. 1. The GOA device includes at least two GOA units which are cascaded. An Nth stage GOA unit of the GOA units is configured to output a gate driving signal to an Nth horizontal scan line. The Nth stage GOA unit includes a pull-up control unit 100, a bootstrap unit 200, a pull-up unit 300, a pull-down unit 400, and a pull-down holding unit 500.

The pull-up control unit 100 receives a starting signal to pull up a control node (Qn) of the Nth stage GOA unit to a first high voltage level in a first phase.

The bootstrap unit 200 pulls up, according to a clock signal, the control node (Qn) of the Nth stage GOA unit to a second high voltage level in a second phase.

The pull-up unit 300 outputs, according to the first high voltage level and the second high voltage level of the control node (Qn) of the Nth stage GOA unit and the clock signal outputted by the bootstrap unit 200, the gate driving signal to a gate signal terminal (Gn) of the Nth stage GOA unit. A pulse width of the gate driving signal is twice a pulse width of the clock signal.

The pull-down unit 400 pulls down the control node (Qn) of the Nth stage GOA unit and the gate signal terminal (Gn) of the Nth stage GOA unit to a first direct current low voltage level in a third phase.

The pull-down holding unit 500 maintains the control node (Qn) of the Nth stage GOA unit as the first direct current low voltage level and maintains the gate signal terminal (Gn) of the Nth stage GOA unit as a second direct current low voltage level in a fourth phase.

In the present disclosure, the pull-up control unit and the bootstrap unit sequentially control the control node of the Nth stage GOA unit to be pulled up to the first high voltage level and the second high voltage level. The pull-up unit outputs the gate driving signal according to a change of the voltage level of the control node and a stage transfer signal of the Nth stage GOA unit. As such, the pulse width of the gate driving signal is increased, and the problem that the charging ability is not sufficient can be solved.

The four operational phases of the Nth stage GOA unit are described as follows.

Please refer to FIG. 1. In the first phase, the pull-up control unit 100 receives the starting signal to pull up the control node (Qn) of the Nth stage GOA unit to the first high voltage level.

In the present embodiment, the pull-up control unit 100 is electrically coupled to a stage transfer signal terminal (STn−4) and a gate signal terminal (Gn−4) of an (N−4)th stage GOA unit and the control node (Qn) of the Nth stage GOA unit. The starting signal comes from the stage transfer signal terminal (STn−4) of the (N−4)th stage GOA unit (N−4)th stage GOA unit.

In the present embodiment, when the pull-up control unit 100 receives the starting signal from the stage transfer signal terminal (STn−4) of the (N−4)th stage GOA unit, the pull-up control unit 100 pulls up the control node (Qn) of the Nth stage GOA unit to the first high voltage level according to the gate signal terminal (Gn−4) of the (N−4)th stage GOA unit. A waveform of the control node (Qn) is at the first high voltage level during the duration in which the starting signal from the stage transfer signal terminal (STn−4) is inputted.

In the present embodiment, the pull-up control unit 100 specifically includes an eleventh thin film transistor (T11). A gate of the eleventh thin film transistor (T11) is electrically coupled to the stage transfer signal terminal (STn−4) of the (N−4)th stage GOA unit to receive the starting signal to turn on the eleventh thin film transistor (T11). A source of the eleventh thin film transistor (T11) is electrically coupled to a gate signal terminal (Gn−4) of the (N−4)th stage GOA unit to receive a gate signal from the gate signal terminal (Gn−4) of the (N−4)th stage GOA unit. A drain of the eleventh thin film transistor (T11) is electrically coupled to the control node (Qn) of the Nth stage GOA unit, so that the control node (Qn) of the Nth stage GOA unit is pulled up to the first high voltage level when the eleventh thin film transistor (T11) is turned on.

Please refer to FIG. 1. In the second phase, the bootstrap unit 200 pulls up, according to the clock signal, the control node (Qn) of the Nth stage GOA unit to the second high voltage level.

In the present embodiment, the bootstrap unit 200 is electrically coupled to the control node (Qn) of the Nth stage GOA unit, a clock signal terminal (CK), and a stage transfer signal terminal (STn) of the Nth stage GOA unit.

In the present embodiment, the clock signal terminal (CK) is configured to provide the clock signal.

In the present embodiment, the second phase starts when the control node (Qn) of the Nth stage GOA unit is pulled up to the first high voltage level. The control node (Qn) of the Nth stage GOA unit is further pulled up to the second high voltage level due to the function of the clock signal.

In the present embodiment, the second high voltage level is higher than the first high voltage level. The second high voltage level may be twice a voltage level (VGH).

In the present embodiment, the bootstrap unit 200 includes a bootstrap capacitor Cb and a twenty-second thin film transistor (T22). The bootstrap capacitor Cb is electrically coupled to the control node (Qn) of the Nth stage GOA unit and the stage transfer signal terminal (STn) of the Nth stage GOA unit. The bootstrap capacitor Cb is configured to pull up and maintain the voltage level of the control node (Qn). A gate of the twenty-second thin film transistor (T22) is electrically coupled to the control node (Qn) of the Nth stage GOA unit. A source of the twenty-second thin film transistor (T22) is electrically coupled to the clock signal terminal (CK). A drain of the twenty-second thin film transistor (T22) is electrically coupled to the stage transfer signal terminal (STn) of the Nth stage GOA unit. The twenty-second thin film transistor (T22) is configured to output another starting signal via the stage transfer signal terminal (STn) of the Nth stage GOA unit to control a next stage GOA unit to be turned on and off.

In the present embodiment, the pull-up unit 300 outputs, according to the first high voltage level and the second high voltage level of the control node (Qn) of the Nth stage GOA unit and the stage transfer signal terminal (STn) of the Nth stage GOA unit, the gate driving signal to the gate signal terminal (Gn) of the Nth stage GOA unit. The pulse width of the gate driving signal is twice the pulse width of the clock signal.

In the present embodiment, the pull-up unit 300 outputs the gate driving signal according to the change of the voltage level of the control node (Qn) and the stage transfer signal of the Nth stage GOA unit.

In the second phase, a waveform of the gate driving signal at the control node (Qn) is at the first high voltage level and the second high voltage level. A pulse waveform of the gate driving signal at the control node (Qn) is pulled up in the two phases. The pulse width of the gate driving signal is approximately twice the pulse width of the clock signal.

In the present embodiment, the pull-up unit 300 is electrically coupled to the control node (Qn) of the Nth stage GOA unit, the stage transfer signal terminal (STn) of the Nth stage GOA unit, and the gate signal terminal (Gn) of the Nth stage GOA unit.

In the present embodiment, the stage transfer signal terminal (STn) of the Nth stage GOA unit is configured to provide a starting signal having a high voltage level to control a thin film transistor in the pull-up unit 300 to be turned on and off.

In the present embodiment, the pull-up unit 300 includes a twenty-first thin film transistor (T21). A gate of the twenty-first thin film transistor (T21) is electrically coupled to the control node (Qn) of the Nth stage GOA unit. A source of the twenty-first thin film transistor (T21) is electrically coupled to the stage transfer signal terminal (STn) of the Nth stage GOA unit. A drain of the twenty-first thin film transistor (T21) is electrically coupled to the gate signal terminal (Gn) of the Nth stage GOA unit to output the gate driving signal to the Nth scan line.

Please refer to FIG. 1. In the third phase, the pull-down unit 400 pulls down the control node (Qn) of the Nth stage GOA unit and the gate signal terminal (Gn) of the Nth stage GOA unit to the first direct current low voltage level.

In the present embodiment, the pull-down unit 400 is electrically coupled to the control node (Qn) of the Nth stage GOA unit, the gate signal terminal (Gn) of the Nth stage GOA unit, a transfer signal terminal (STn+4) of an (N+4)th stage GOA unit, and a first direct current low voltage level terminal (VSSQ).

In the present embodiment, when the transfer signal terminal (STn+4) of the (N+4)th stage GOA unit outputs a high voltage level, the pull-down unit 400 pulls down the control node (Qn) of the Nth stage GOA unit and the gate signal terminal (Gn) of the Nth stage GOA unit to the first direct current low voltage level provided by the first direct current low voltage level terminal (VSSQ).

In the present embodiment, the third phase starts when the transfer signal terminal (STn+4) of the (N+4)th stage GOA unit is at the high voltage level. The waveform of the gate driving signal is pulled down from the high voltage level to the low voltage level during the duration in which the transfer signal terminal (STn+4) is at the high voltage level.

In the present embodiment, the pull-down unit 400 mainly includes a thirty-first thin film transistor (T31) and a forty-first thin film transistor (T41). A source of the thirty-first thin film transistor (T31) is electrically coupled to the gate signal terminal (Gn) of the Nth stage GOA unit. A source of the forty-first thin film transistor (T41) is electrically coupled to the control node (Qn) of the Nth stage GOA unit.

A drain of the thirty-first thin film transistor (T31) and a drain of the forty-first thin film transistor (T41) are electrically coupled to the first direct current low voltage level terminal (VSSQ). A gate of the thirty-first thin film transistor (T31) and a gate of the forty-first thin film transistor (T41) are electrically coupled to the transfer signal terminal (STn+4) of the (N+4)th stage GOA unit.

Please refer to FIG. 1. In the fourth phase, the pull-down holding unit 500 maintains the control node (Qn) of the Nth stage GOA unit as the first direct current low voltage level and maintains the gate signal terminal (Gn) of the Nth stage GOA unit as the second direct current low voltage level.

In the present embodiment, the pull-down holding unit 500 is electrically coupled to the control node (Qn) of the Nth stage GOA unit, the gate signal terminal (Gn) of the Nth stage GOA unit, direct current signal terminals, the first direct current low voltage level terminal (VSSQ), and a second direct current low voltage level terminal (VSSG).

In the present embodiment, the pull-down holding unit 500 maintains the control node (Qn) of the Nth stage GOA unit as the first direct current low voltage level and maintains the gate signal terminal (Gn) of the Nth stage GOA unit as the second direct current low voltage level provided by the second direct current low voltage level terminal (VSSG).

In the present embodiment, the pull-down holding unit 500 may include a first pull-down holding unit 501 and a second pull-down holding unit 502.

The first pull-down holding unit 501 includes a fifty-first thin film transistor (T51), a fifty-second thin film transistor (T52), a fifty-third thin film transistor (T53), a fifty-fourth thin film transistor (T54), a forty-second thin film transistor (T42), and a thirty-second thin film transistor (T32).

A gate and a drain of the fifty-first thin film transistor (T51) are electrically coupled to a first direct current signal terminal LC1. A source of the fifty-first thin film transistor (T51) is electrically coupled to a drain of the fifty-second thin film transistor (T52) and a gate of the fifty-third thin film transistor (T53).

A gate of the fifty-second thin film transistor (T52) is electrically coupled to an output terminal of the pull-up control unit 100. A source of the fifty-second thin film transistor (T52) is electrically coupled to the first direct current low voltage level terminal (VSSQ).

A drain of the fifty-third thin film transistor (T53) is electrically coupled to the first direct current signal terminal LC1. A source of the fifty-third thin film transistor (T53) is electrically coupled to a drain of the fifty-fourth thin film transistor (T54), a gate of the forty-second thin film transistor (T42), and a gate of the thirty-second thin film transistor (T32).

A gate of the fifty-fourth thin film transistor (T54) is electrically coupled to the output terminal of the pull-up control unit 100. A source of the fifty-fourth thin film transistor (T54) is electrically coupled to the first direct current low voltage level terminal (VSSQ).

A source of the forty-second thin film transistor (T42) is electrically coupled to the first direct current low voltage level terminal (VSSQ). A drain of the forty-second thin film transistor (T42) is electrically coupled to the output terminal of the pull-up control unit 100.

A source of the thirty-second thin film transistor (T32) is electrically coupled to the second direct current low voltage level terminal (VSSG). A drain of the thirty-second thin film transistor (T32) is electrically coupled to an output terminal of the gate driving signal of the Nth stage GOA unit.

The second pull-down holding unit 502 includes a sixty-first thin film transistor (T61), a sixty-second thin film transistor (T62), a sixty-third thin film transistor (T63), a sixty-fourth thin film transistor (T64), a forty-third thin film transistor (T43), and a thirty-third thin film transistor (T33).

A gate and a drain of the sixty-first thin film transistor (T61) are electrically coupled to a second direct current signal terminal LC2. A source of the sixty-first thin film transistor (T61) is electrically coupled to a drain of the sixty-second thin film transistor (T62) and a gate of the sixty-third thin film transistor (T63).

A gate of the sixty-second thin film transistor (T62) is electrically coupled to the output terminal of the pull-up control unit 100. A source of the sixty-second thin film transistor (T62) is electrically coupled to the first direct current low voltage level terminal (VSSQ).

A drain of the sixty-third thin film transistor (T63) is electrically coupled to the second direct current signal terminal LC2. A source of the sixty-third thin film transistor (T63) is electrically coupled to a drain of the sixty-fourth thin film transistor (T64), a gate of the forty-third thin film transistor (T43), and a gate of the thirty-third thin film transistor (T33).

A gate of the sixty-fourth thin film transistor (T64) is electrically coupled to the output terminal of the pull-up control unit 100. A source of the sixty-fourth thin film transistor (T64) is electrically coupled to the first direct current low voltage level terminal (VSSQ).

A source of the forty-third thin film transistor (T43) is electrically coupled to the first direct current low voltage level terminal (VSSQ). A drain of the forty-third thin film transistor (T43) is electrically coupled to the output terminal of the pull-up control unit 100.

A source of the thirty-third thin film transistor (T33) is electrically coupled to the second direct current low voltage level terminal (VSSG). A drain of the thirty-third thin film transistor (T33) is electrically coupled to the output terminal of the gate driving signal of the Nth stage GOA unit.

In the present embodiment, a voltage at the first direct current signal terminal LC1 may be lower than a voltage at the second direct current signal terminal LC2. Accordingly, the drain of the thirty-first thin film transistor (T31) is electrically coupled to the first direct current low voltage level terminal (VSSQ). In comparison with the drain of the thirty-first thin film transistor (T31) electrically coupled to the second direct current low voltage level terminal (VSSG), a falling time of a waveform outputted by the Nth stage GOA unit can be correspondingly decreased when the drain of the thirty-first thin film transistor (T31) is electrically coupled to the first direct current low voltage level terminal (VSSQ). As such, the problem that the display quality of an image is poor because the falling time is long can be solved.

The present disclosure further provides a gate driving circuit. The gate driving circuit includes the above-mentioned GOA device. An operating principle of the gate driving circuit is the same as or similar to an operating principle of the above-mentioned GOA device and not repeated herein.

The present disclosure provides the GOA device and the gate driving circuit. The GOA device includes the at least two GOA units which are cascaded. Each of the GOA units includes the pull-up control unit, the bootstrap unit, the pull-up unit, the pull-down unit, and the pull-down holding unit. In the present disclosure, the pull-up control unit and the bootstrap unit sequentially control the control node of the Nth stage GOA unit to be pulled up to the first high voltage level and the second high voltage level. The pull-up unit outputs the gate driving signal according to the change of the voltage level of the control node and the stage transfer signal of the Nth stage GOA unit. As such, the pulse width of the gate driving signal is increased, and the problem that the charging ability is not sufficient can be solved.

It can be appreciated that many other possible modifications and variations can be made by those skilled in the art without departing from the spirit and scope of the present disclosure as hereinafter claimed, and those modifications and variations are considered encompassed in the scope of protection defined by the claims of the present disclosure.

What is claimed is:

1. A gate driving circuit, wherein the gate driving circuit comprises a GOA device, the GOA device comprises at least two GOA units which are cascaded, an Nth stage GOA unit of the GOA units is configured to output a gate driving signal to an Nth horizontal scan line, and the Nth stage GOA unit comprises a pull-up control unit, a bootstrap unit, a pull-up unit, a pull-down unit, and a pull-down holding unit;

the pull-up control unit receives a starting signal to pull up a control node (Qn) of the Nth stage GOA unit to a first high voltage level in a first phase;

the bootstrap unit pulls up, according to a clock signal, the control node (Qn) of the Nth stage GOA unit to a second high voltage level in a second phase;

the pull-up unit outputs, according to the first high voltage level and the second high voltage level of the control node (Qn) of the Nth stage GOA unit and the clock signal outputted by the bootstrap unit, the gate driving signal to a gate signal terminal (Gn) of the Nth stage GOA unit, and a pulse width of the gate driving signal is twice a pulse width of the clock signal;

the pull-down unit pulls down the control node (Qn) of the Nth stage GOA unit and the gate signal terminal (Gn) of the Nth stage GOA unit to a first direct current low voltage level in a third phase;

the pull-down holding unit maintains the control node (Qn) of the Nth stage GOA unit as the first direct current low voltage level and maintains the gate signal terminal (Gn) of the Nth stage GOA unit as a second direct current low voltage level in a fourth phase;

wherein the pull-down unit is electrically coupled to the control node (Qn) of the Nth stage GOA unit, the gate signal terminal (Gn) of the Nth stage GOA unit, a transfer signal terminal (STn+4) of an (N+4)th stage GOA unit, and a first direct current low voltage level terminal (VSSQ);

the first direct current low voltage level terminal (VSSQ) is configured to provide the first direct current low voltage level;

the third phase starts when the transfer signal terminal (STn+4) of the (N+4)th stage GOA unit is at a high voltage level;

wherein the pull-down unit comprises a thirty-first thin film transistor (T31) and a forty-first thin film transistor (T41);

a source of the thirty-first thin film transistor (T31) is electrically coupled to the gate signal terminal (Gn) of the Nth stage GOA unit, and a source of the forty-first thin film transistor (T41) is electrically coupled to the control node (Qn) of the Nth stage GOA unit;

a drain of the thirty-first thin film transistor (T31) and a drain of the forty-first thin film transistor (T41) are electrically coupled to the first direct current low voltage level terminal (VSSQ), and a gate of the thirty-first thin film transistor (T31) and a gate of the forty-first thin film transistor (T41) are electrically coupled to the transfer signal terminal (STn+4) of the (N+4)th stage GOA unit.

2. The gate driving circuit of claim 1, wherein the pull-up control unit is electrically coupled to a stage transfer signal terminal (STn−4) and a gate signal terminal (Gn−4) of an (N−4)th stage GOA unit and the control node (Qn) of the Nth stage GOA unit;

in the first phase, the pull-up control unit receives the starting signal from the stage transfer signal terminal (STn−4) of the (N−4)th stage GOA unit to pull up the control node (Qn) of the Nth stage GOA unit to the first high voltage level.

3. The gate driving circuit of claim 2, wherein the pull-up control unit comprises an eleventh thin film transistor (T11);

a gate of the eleventh thin film transistor (T11) is electrically coupled to the stage transfer signal terminal (STn−4) of the (N−4)th stage GOA unit; a source of the eleventh thin film transistor (T11) is electrically coupled to a gate signal terminal (Gn−4) of the (N−4)th stage GOA unit; and a drain of the eleventh thin film transistor (T11) is electrically coupled to the control node (Qn) of the Nth stage GOA unit.

4. The gate driving circuit of claim 1, wherein the bootstrap unit is electrically coupled to the control node (Qn) of the Nth stage GOA unit, a clock signal terminal (CK), and a stage transfer signal terminal (STn) of the Nth stage GOA unit;

the clock signal terminal (CK) is configured to provide the clock signal;

the second phase starts when the control node (Qn) of the Nth stage GOA unit is pulled up to the first high voltage level.

5. The gate driving circuit of claim 4, wherein the bootstrap unit comprises a bootstrap capacitor and a twenty-second thin film transistor (T22);

the bootstrap capacitor is electrically coupled to the control node (Qn) of the Nth stage GOA unit and the stage transfer signal terminal (STn) of the Nth stage GOA unit;

a gate of the twenty-second thin film transistor (T22) is electrically coupled to the control node (Qn) of the Nth stage GOA unit, a source of the twenty-second thin film transistor (T22) is electrically coupled to the clock signal terminal (CK), and a drain of the twenty-second thin film transistor (T22) is electrically coupled to the stage transfer signal terminal (STn) of the Nth stage GOA unit.

6. The gate driving circuit of claim 1, wherein the pull-up unit is electrically coupled to the control node (Qn) of the Nth stage GOA unit, the stage transfer signal terminal (STn) of the Nth stage GOA unit, and the gate signal terminal (Gn) of the Nth stage GOA unit;

the stage transfer signal terminal (STn) of the Nth stage GOA unit is configured to provide a starting signal to control a thin film transistor in the pull-up unit to be turned on and off.

7. The gate driving circuit of claim 6, wherein the pull-up unit comprises a twenty-first thin film transistor (T21);

a gate of the twenty-first thin film transistor (T21) is electrically coupled to the control node (Qn) of the Nth stage GOA unit; a source of the twenty-first thin film transistor (T21) is electrically coupled to the stage transfer signal terminal (STn) of the Nth stage GOA unit, and a drain of the twenty-first thin film transistor (T21) is electrically coupled to the gate signal terminal (Gn) of the Nth stage GOA unit.

8. A GOA device, comprising at least two GOA units which are cascaded, wherein an Nth stage GOA unit of the GOA units is configured to output a gate driving signal to an Nth horizontal scan line, and the Nth stage GOA unit comprises a pull-up control unit, a bootstrap unit, a pull-up unit, a pull-down unit, and a pull-down holding unit;

the pull-up control unit receives a starting signal to pull up a control node (Qn) of the Nth stage GOA unit to a first high voltage level in a first phase;

the bootstrap unit pulls up, according to a clock signal, the control node (Qn) of the Nth stage GOA unit to a second high voltage level in a second phase;

the pull-up unit outputs, according to the first high voltage level and the second high voltage level of the control node (Qn) of the Nth stage GOA unit and the clock signal outputted by the bootstrap unit, the gate driving signal to a gate signal terminal (Gn) of the Nth stage GOA unit, and a pulse width of the gate driving signal is twice a pulse width of the clock signal;

the pull-down unit pulls down the control node (Qn) of the Nth stage GOA unit and the gate signal terminal (Gn) of the Nth stage GOA unit to a first direct current low voltage level in a third phase;

the pull-down holding unit maintains the control node (Qn) of the Nth stage GOA unit as the first direct current low voltage level and maintains the gate signal terminal (Gn) of the Nth stage GOA unit as a second direct current low voltage level in a fourth phase;

wherein the pull-down unit is electrically coupled to the control node (Qn) of the Nth stage GOA unit, the gate signal terminal (Gn) of the Nth stage GOA unit, a transfer signal terminal (STn+4) of an (N+4)th stage GOA unit, and a first direct current low voltage level terminal (VSSQ);

the first direct current low voltage level terminal (VSSQ) is configured to provide the first direct current low voltage level;

the third phase starts when the transfer signal terminal (STn+4) of the (N+4)th stage GOA unit is at a high voltage level;

the pull-down unit comprises a thirty-first thin film transistor (T31) and a forty-first thin film transistor (T41);

a source of the thirty-first thin film transistor (T31) is electrically coupled to the gate signal terminal (Gn) of the Nth stage GOA unit, and a source of the forty-first thin film transistor (T41) is electrically coupled to the control node (Qn) of the Nth stage GOA unit;

a drain of the thirty-first thin film transistor (T31) and a drain of the forty-first thin film transistor (T41) are electrically coupled to the first direct current low voltage level terminal (VSSQ), and a gate of the thirty-first thin film transistor (T31) and a gate of the forty-first thin film transistor (T41) are electrically coupled to the transfer signal terminal (STn+4) of the (N+4)th stage GOA unit.

9. The GOA device of claim 8, wherein the pull-up control unit is electrically coupled to a stage transfer signal terminal (STn−4) and a gate signal terminal (Gn−4) of an (N−4)th stage GOA unit and the control node (Qn) of the Nth stage GOA unit;

in the first phase, the pull-up control unit receives the starting signal from the stage transfer signal terminal (STn−4) of the (N−4)th stage GOA unit to pull up the control node (Qn) of the Nth stage GOA unit to the first high voltage level.

10. The GOA device of claim 9, wherein the pull-up control unit comprises an eleventh thin film transistor (T11);

a gate of the eleventh thin film transistor (T11) is electrically coupled to the stage transfer signal terminal (STn−4) of the (N−4)th stage GOA unit, a source of the eleventh thin film transistor (T11) is electrically coupled to a gate signal terminal (Gn−4) of the (N−4)th stage GOA unit, and a drain of the eleventh thin film transistor (T11) is electrically coupled to the control node (Qn) of the Nth stage GOA unit.

11. The GOA device of claim 8, wherein the bootstrap unit is electrically coupled to the control node (Qn) of the Nth stage GOA unit, a clock signal terminal (CK), and a stage transfer signal terminal (STn) of the Nth stage GOA unit;

the clock signal terminal (CK) is configured to provide the clock signal;

the second phase starts when the control node (Qn) of the Nth stage GOA unit is pulled up to the first high voltage level.

12. The GOA device of claim 11, wherein the bootstrap unit comprises a bootstrap capacitor and a twenty-second thin film transistor (T22);

the bootstrap capacitor is electrically coupled to the control node (Qn) of the Nth stage GOA unit and the stage transfer signal terminal (STn) of the Nth stage GOA unit;

a gate of the twenty-second thin film transistor (T22) is electrically coupled to the control node (Qn) of the Nth stage GOA unit, a source of the twenty-second thin film transistor (T22) is electrically coupled to the clock signal terminal (CK), and a drain of the twenty-second thin film transistor (T22) is electrically coupled to the stage transfer signal terminal (STn) of the Nth stage GOA unit.

13. The GOA device of claim 8, wherein the pull-up unit is electrically coupled to the control node (Qn) of the Nth stage GOA unit, the stage transfer signal terminal (STn) of the Nth stage GOA unit, and the gate signal terminal (Gn) of the Nth stage GOA unit;

the stage transfer signal terminal (STn) of the Nth stage GOA unit is configured to provide a starting signal to control a thin film transistor in the pull-up unit to be turned on and off.

14. The GOA device of claim 13, wherein the pull-up unit comprises a twenty-first thin film transistor (T21);

a gate of the twenty-first thin film transistor (T21) is electrically coupled to the control node (Qn) of the Nth stage GOA unit, a source of the twenty-first thin film transistor (T21) is electrically coupled to the stage transfer signal terminal (STn) of the Nth stage GOA unit, and a drain of the twenty-first thin film transistor (T21) is electrically coupled to the gate signal terminal (Gn) of the Nth stage GOA unit.

* * * * *